United States Patent [19]

Wu

[11] Patent Number: 4,488,155

[45] Date of Patent: Dec. 11, 1984

[54] METHOD AND APPARATUS FOR SELF-CALIBRATION AND PHASING OF ARRAY ANTENNA

[75] Inventor: Chialin Wu, Pasadena, Calif.

[73] Assignee: The United States of America as represented by the Administrator of the National Aeronautics and Space Administration, Washington, D.C.

[21] Appl. No.: 403,848

[22] Filed: Jul. 30, 1982

[51] Int. Cl.[3] ..... H01Q 3/00

[52] U.S. Cl. ..... 343/376; 343/17.7

[58] Field of Search ..... 343/17.7, 368, 371, 343/376, 703

[56] References Cited

U.S. PATENT DOCUMENTS

| | | | |
|---|---|---|---|
| 3,922,680 | 11/1975 | Alsberg | 343/371 |
| 3,967,279 | 6/1976 | Zeger | 343/117 A |
| 4,308,539 | 12/1981 | Birch | 343/100 SA |

*Primary Examiner*—Eli Lieberman

*Attorney, Agent, or Firm*—Paul F. McCaul; Thomas H. Jones; John R. Manning

[57] ABSTRACT

A technique for self-calibration and phasing of a lens-feed array antenna, while normal operation is stopped, utilizes reflected energy of a continuous and coherent wave broadcast by a transmitter (11) through a central feed (10) while a phase controller (21) advances the phase angles of reciprocal phase shifters (14) in radiation electronics (RE1-REN) of the array elements (1-N) at different rates to provide a distinct frequency modulation of electromagnetic wave energy returned by reflection in one mode (switch 19 closed) and leakage in another mode (switch 19 open) from the radiation electronics of each array element. The composite return signal received by a synchronous receiver (12) goes through a Fourier transform processing system (20) and produces a response function for each antenna element. Compensation of the phase angles for the antenna elements required to conform the antenna response to a precomputed array pattern is derived from the reciprocal square root of the response functions for the antenna elements which, for a rectangular array of N×M elements, is a response function T(n,m). A third mode of calibration uses an external pilot tone from a separate antenna element (44). Respective responses $T_1(n,m)$, $T_2(n,m)$ and $T_3(n,m)$ are thus obtained from the three modes of calibration. From those, the separate responses $T_\phi$, $T_t$ and $T_r$ of the reciprocal phase shifter, radiation electronics, and synchronous receiver can be obtained by solving the following three simultaneous equations:

$$T_\phi(n,m)=T_1(n,m)$$

$$T_\phi(n,m)\times T_t(n,m)\times T_r(n,m)=T_2(n,m)$$

$$T_\phi^{\frac{1}{2}}(n,m)\times T_r(n,m)=T_3(n,m).$$

14 Claims, 5 Drawing Figures

METHOD AND APPARATUS FOR SELF-CALIBRATION AND PHASING OF ARRAY ANTENNA

ORIGIN OF INVENTION

The invention described herein was made in the performance of work under a NASA contract and is subject to the provisions of Section 305 of the National Aeronautics and Space Act of 1958, Pubilc Law 85-568 (72 Stat. 435; 42 USC 2457).

BACKGROUND OF THE INVENTION

This invention relates to a method and apparatus for calibrating the amplitude and phase performance of each array element of a large phase array antenna and thereby derive phasing factors necessary to operate the array. One particular application is for a spaceborne large phase array where the possible deformations of array structure away from its prespecified pattern cause phase error in addition to the drift of electrical response with array elements.

Conventional array antenna technology, which places array elements on a plane surface, has imposed a practical limit on the size of the array, since the requirements on structure deformation become more stringent for a greater antenna size or a higher radar tansmitter frequency. Current state of the art for array dimensions is 2 m×10.5 m for the SEASAT synthetic aperture radar (SAR) operating at L-band. Array dimensions of several times greater than that are highly desirable for extremly wide swath-width SAR imaging operating at L-band or higher (e.g. C-band frequency). To alleviate the mechanical structure problems, one possible solution is to deploy a self-phased antenna array which applies a servo-loop control to detect and adjust the phase of each array element automatically, thereby to obtain a desired wavefront pattern regardless of the position of each element to the plane of the array. This self-phasing concept is also crucial to the development of spaceborne antenna systems with loose or no mechanical coupling between the array elements. Future array systems may also incorporate distributed radiator/receiver elements. Each element is subject to different drift in its electrical response. Being able to perform effective amplitude and phase calibration for each of the array elements is absolutely needed to operate a phase array antenna with a large number of distributed active elements.

SUMMARY OF THE INVENTION

In accordance with the present invention, a conventional lens-feed array antenna is provided with a Fourier transform processing system which receives, through the central feed of the array, internally reflected echo signal at steps synchronous to a discrete phase shift operation that is unique for each antenna element during antenna calibration. Upon completion of a systematic phase shifting operation, the output of the Fourier transform processing system corresponds to the amplitude and phase response of the elements in a phase array. Conjugative compensations can thus be made at each element to achieve a desired antenna radiation pattern.

During calibration, the radiator electronics for the elements of the array is set for a desired antenna array pattern with precomputed phase ($\psi$) and amplitude (A) set points and switched from its normal operation to a calibrate mode while a coherent pilot-tone signal is broadcast from a central feed to all feed ports of the radiator electronics for the array elements. The radiator electronics for each array element includes an independent reciprocal phase shifter, which, by this calibration procedure, is adjusted to achieve the desired antenna response pattern. In one exemplary embodiment, the radiator electronics is provided with power amplifier and receiver preamplifier gain such that energy will leak through a circulator (used to connect these amplifiers to the array element) back to the central feed. A synchronous receiver connected to the central feed is thus provided with an echo signal from each element that may be analyzed by the Fourier transform processor to determine the response T(n,m) of the antenna. The reciprocal of the square root of this response for each element provides an error signal that is multiplied with the precomputed values that initially set the desired antenna array pattern. The product is then converted into phase ($\psi$) and amplitude (A) control signals for the different array elements applied to the radiator electronics of the respective elements. The phase shifters are thus controlled to compensate their angles to that of a desired antenna array pattern. In another embodiment, a short circuit switch is actuated to cause the echo signal to be reflected after having passed through just the reciprocal phase shifter, it being assumed that the time delay through the radiator electronics is constant and the same for each array element except for the adjustment of its reciprocal phase adjuster. These two embodiments may both be included for calibration in two different modes. A third calibration mode uses an external stationary pilot tone received through a separate antenna element as a reference. If all three modes are used, three distinct responses T(n,m) are determined by the Fourier transform processor. The response of the reciprocal phase shifter, distributed transmitters (radiation electronics) and the synchronous receiver $T_\phi$, $T_t$ and $T_r$, respectively, can be obtained by solving the following three simultaneous equations:

$$T_{t100}(n.m) = T_1(n.m)$$

$$T_{t100}(n.m) \times T_t(n.m) \times T_r(n.m) = T_2(n.m)$$

$$T_\phi^{\frac{1}{2}}(n.m) \times T_r(n.m) = T_3(n.m)$$

where $T_1(n,m)$ is the response with the short circuit switch activated, $T_2(n,m)$ is the response with the short circuit switch open, and $T_3(n,m)$ is the response with the pilot tone received directly through a separate antenna element.

DESCRIPTION OF PREFERRED EMBODIMENTS

Figure 1:
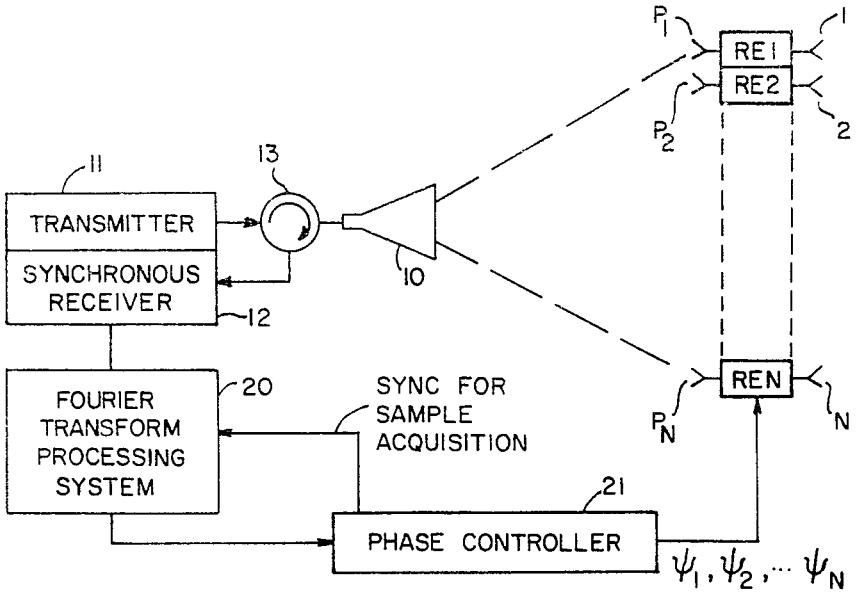
FIG. 1 illustrates in a block diagram the general arrangement for an array antenna embodying the present invention.
Figure 2:
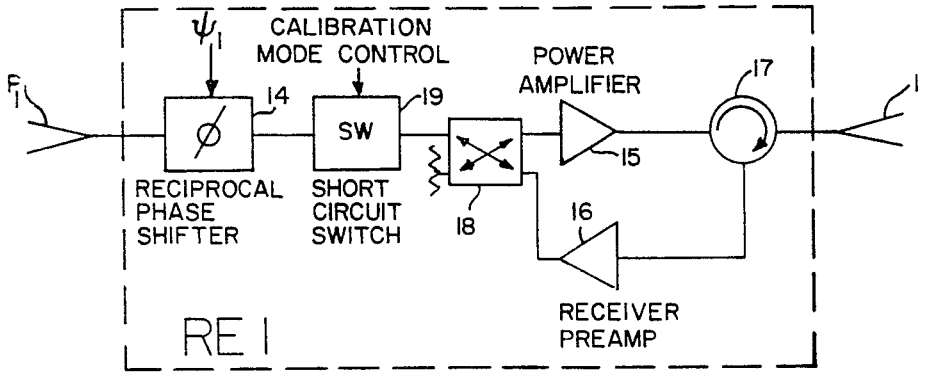
FIG. 2 illustrates an exemplary implementation of radiator electronics provided for each antenna element of the array in FIG. 1.

A lens-feed or space-feed array generally takes the form shown in FIG. 1. Shown on the left side is a central feed 10 linked to a transmitter 11 and a synchronous receiver 12 by a circulator 13. Shown on the right side is a one- or two-dimensional array of antenna elements 1, 2 . . . N disposed to provide a planar wavefront. The antenna elements include radiator electronics RE1, RE2 . . . REN implemented as shown in FIG. 2, for example, between it and its respective feed ports, $P_1$, $P_2$ . . . $P_N$.

Since the radiator electronics is the same for all antenna elements, only the one for the first antenna element will be described with reference to FIG. 2. It contains a reciprocal phase-shifter 14, power and receiver amplifiers 15 and 16, and a circulator 17. A directional coupler 18 is provided to couple transmitted energy from the phase shifter 14 to the power amplifier 15, and to couple received energy from the amplifier 16 to the phase shifter 14. A microwave short circuit switch 19 is provided to short circuit the transmission between the phase shifter and amplifiers during a calibration mode of operation.

A Fourier transform processor 20 is provided with its input being the synchronously carrier-demodulated signal obtained from the central receiver 12. The timing for data acquisition of the Fourier transform processor is coupled to a phase shift control unit 21 only for calibration. The calibration procedure is described as follows:

(1) The array stops its normal operation when calibration begins under control of a calibration signal.

(2) During calibration, the central feed 10 broadcasts a continuous and coherent pilot-tone signal to all feed ports $P_1$, $P_2$ . . . $P_N$. For an active array, the gain of the radiator electronics (see FIG. 2 ) will be set such that part of the energy will leak through the circulator 17 and be amplified by the receiver amplifier 16 to return energy to the central feed through the reciprocal phase shifter 14. This reflection could also be achieved through the short circuit switch 19 included for this purpose and activated by the calibration mode control signal or by an impedance mismatch in the signal path after the reciprocal phase shifter 14.

Figure 3:
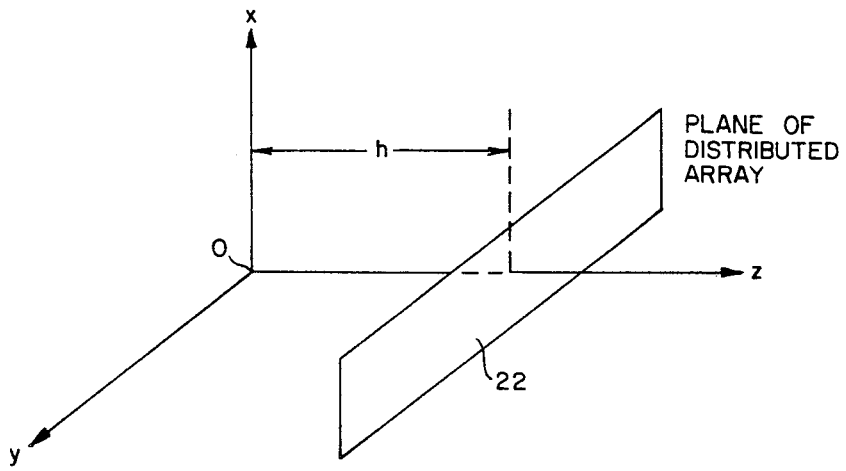
FIG. 3 illustrates the geometry of interest for a two-dimensional array a specified distance from a central feed.

(3) The phase shifters are first set at their ideal values for lens operation focused on the central feeder 10. For a two-dimensional array, represented in FIG. 3 by an x-y plane 22 with a distance h from the position 0 of the central feed 10 (FIG. 1) to the array center, the ideal phase angle, $\phi$, for an element located at position (x,y) for lens operation is $$\phi_o(x,y) = -\frac{2\pi}{\lambda}\left(\sqrt{h^2 + x^2 + y^2} - h\right) \tag{1}$$

(4) the phase shifters are now commanded by the phase controller 21 to advance their angles. Discrete time steps are taken to perform this function. The phase shifters advance at different rates relative to one another. For a two-dimensional array, with N×M elements located on a rectangular grid, a systematic way to shift the phase angles at timimg step k for each element labeled (n,m), where $n=x/d_1$, $m=y/d_2$, and $d_1$ and $d_2$ are element spacing in x and y, respectively, is $$\phi(n,m,k) = \pi\left(k_1\frac{n}{N} + k_2\frac{m}{M}\right) \tag{2}$$

where $k_1$, $k_2$ are related to k by $$k = Nk_2 + k_1 \tag{3}$$

and $$N - 1 \geqq k_1 \geqq 0$$

$$M - 1 \geqq k_2 \geqq 0$$

(5) The signal received by the central receiver goes through a coherent carrier demodulation. Totally N×M timing steps are taken to increase the phase angles at the array elements. The demodulated signals are sampled at timing steps synchronous to the phase shifting. N×M discrete samples $Q(k_1, k_2)$ are taken and input to the Fourier transform processor. An N×M two-dimensional discrete Fourier transform is performed on the N×M samples. The amplitude and phase of each complex Fourier coefficient T(n,m)

$$T(n,m) = \frac{1}{NM}\sum_{k_2=0}^{M-1}\sum_{k_1=0}^{N-1} Q(k_1,k_2) \times \exp\left[-j2\pi\left(\frac{k_1 n}{N} + \frac{k_2 m}{M}\right)\right] \tag{4}$$

corresponds directly to the amplitude and phase response of a particular array element (n,m). That is, the output of the Fourier processor maps directly to the amplitude and phase response of the array antenna. Of course, many independent measures T(n,m) can be taken for each element and vectorially averaged to improve the estimation accuracy.

(6) The same operation described in steps 2 to 5 may be repeated several times at different carrier frequencies for the purpose of resolving the $2\pi$ ambiguity in the phase determination.

(7) The reciprocal of the square root of T(n,m), i.e., $T(n,m)^{-\frac{1}{2}}$, will now be applied to each array element as compensating amplitude and phase factors. These factors compensate the offset in antenna response with respect to that of a desired lens-feed array.

The operation described by the seven steps above is straightforward, and can operate autonomously on a moving platform, such as a satellite. Iteration of the above steps may be used to minimize the residual error in estimating the array transmittance.

For a relatively stationary array platform, or when the motion between the sensor and a radiating source position is capable of being determined accurately, an external pilot tone can be used to calibrate the response of the array receiving path using the same synchronous phase shifting and Fourier processing. The system response indeed will be measured more accurately if the self-calibration feature is used to measure the overall array response and the external pilot tone is used for the receiving path.

CONCEPTUAL EXPLANATION OF THEORY

A conceptual explanation is that by modulating the phase shift angle of each array element at a different rate, each phase shifter introduces a frequency modulation to the reflected carrier wave. The frequency of each array element is distinct (see Equation (2)), and is resolved by the Fourier transform. The amplitude of the Fourier transformed coefficient is the amplitude response of the array element. The phase angles should all be zero for an idealized perfect system, because the original phase shift in the reciprocal phase shifter according to Equation (1) does compensate for the different path lengths and achieve the lens focusing effect. The residue phase error of the array element which is a constant throughout the phasing operation, is indeed one-half of the phase term as a result of the synchronous phase detection by Fourier transform.

A. Formulation for Lens Feed Array Calibrator

The mathematical proof of the concept, and the rationale for choosing the phase factor as described in equation (2), is given here. The total phase delay in a microwave transmission system is an additive quantity over the delay in various serial elements in the transmission path. The original set of phase bias as given in equation 1 is unchanged during the phasing operation. In this sense, the original phase bias terms still function as a perfect lens. However, the array response which amounts to an unknown but stationary amplitude gain and additive phase delay for each array element, functions as a complex transmittance T(x,y) or T(n,m) at the array plane. During calibration operation, the synchronously sampled signals after coherent demodulation denoted by $Q(k_1, k_2)$ is expressed by:

$$Q(k_1,k_2) = \sum_{m=1}^{M-1}\sum_{m=1}^{N-1} \exp[j2(\phi_1(n,m) + \phi_o(n,m)] \times T(n,m)\exp[j2\pi\left(\frac{k_1 n}{N} + \frac{k_2 m}{M}\right) \quad (5)$$

where $\phi_1(n,m)$ corresponds to the path delay from the feeder to the array plane. Note that the original lens function as defined by $\phi_o(n,m)$ of equation (1) is designed to compensate for this path delay. Also note that the phase shift of Equation (2) is doubled because of the round trip delay. Equation (5) thus can be written as:

$$Q(k_1,k_2) = \sum_{m=0}^{M-1}\sum_{n=0}^{N-1} T(n,m)\ \exp\left[j2\pi\left(\frac{k_1 n}{N} + \frac{k_2 m}{M}\right)\right] \quad (6)$$

Equation (6) takes the form of a Fourier summation, or a discrete inverse Fourier transform. It is obvious from the above expression that the transmittance T(n,m) can be evaluated by a Fourier transform given by Equation (4):

$$T(n,m) = \frac{1}{NM}\sum_{k_2=0}^{M-1}\sum_{k_1=0}^{N-1} Q(k_1,k_2) \cdot \exp\left[-j2\pi\left(\frac{k_1 n}{N} + \frac{k_2 m}{M}\right)\right] \quad (7)$$

Each term T(n,m) contains an amplitude and a phase factor. For a lens-feed array with active elements, the following conditions hold:

(1) If reflection of the pilot tone provided by the feeder is made immediately after the reciprocal phase shifter using impedance mismatching or a short circuit switch, and assuming the losses of the phase shifts are approximately equal, then $T_1(n,m)$ in this case measures mainly the deviation of path delay (subject to $2\pi$ ambiguity). The amplitude factor is related to the radiation pattern of the feeder and array port, and the path length from array element to the feeder, which are likely constants over the normal array operation period.

(2) If reflection is made through amplification of leakage of the circulator in an array element, then $T_2(n,m)$ measures the composite effect of deviation of path delay due to array deformation, and the amplitude and phase responses of the radiating and receiving electronics.

(3) If an external stationary pilot tone is used, the response of the synchronous receiver alone is calibrated. The calibration operation itself is unchanged other than no transmission from the central feed, and the Fourier transform processing system uses the signal received directly from a separate antenna. However, the measured receiver transmittance now contains a fixed bias factor relating to the orientation of the external remote pilot-tone source. This factor must be removed assuming the location of motion of the remote source is known. The factor R(n,m) is given by:

$$R(n,m) = \exp\left[-j\frac{2\pi}{\lambda z}(d_1 nu + d_2 mv)\right] \quad (8)$$

where (u, v, z) denotes the position of the pilot-tone source. The resultant $T_3(n,m)$ now is the response of the synchronous receiver only.

(4) If all three operations of the above are obtained, the responses of the reciprocal phase shifter, radiation electronics and synchronous receiver, denoted by $T_{100}$, $T_t$ and $T_r$, respectively, can be obtained by solving the following three simultaneous equations:

$$T_\phi(n,m) = T_1(n,m) \quad (9)$$

$$T_\phi(n,m) \times T_t(n,m) \times T_r(n,m) = T_2(n,m)$$

$$T_\phi^{\frac{1}{2}}(n,m) \times T_r(n,m) = T_3(n,m)$$

where we assume all $T_1$, $T_2$ and $T_3$ are properly compensated for known amplitude factors of feed and pattern of array element.

B. Phase Offset and Array Geometric Deformation

Figure 4:
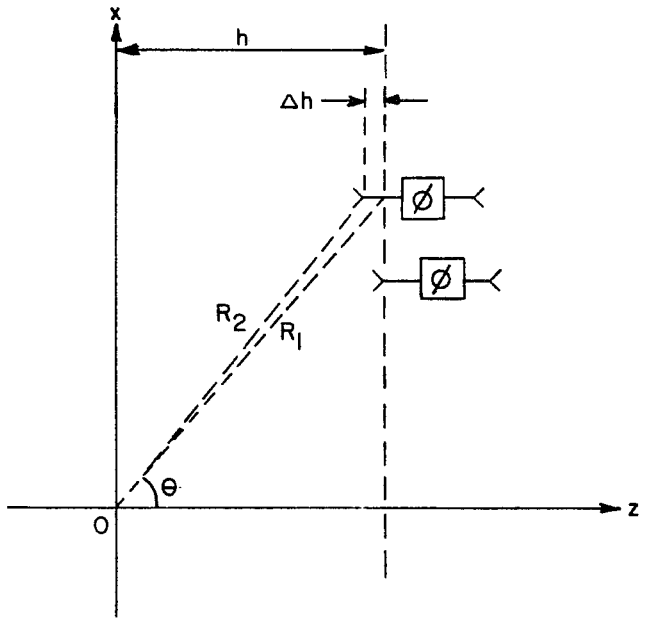
FIG. 4 illustrates the geometry which gives rise to a relationship betweeh phase and position deviation for an antenna element in an array.

Using a distributed active array, where all array elements are fabricated in the near identical process and are operated under almost the same electrical and thermal environment, the drift in T(n,m) can be mainly caused by a small deviation of element positions in a direction perpendicular to the array plane. Let $\psi(n,m)$ be the associated phase drift. Referring to the geometry diagramed in FIG. 4, the relationship between phase and position deviation, $\Delta h$, is $$\psi(n,m) = \frac{2\pi}{\lambda}2R_2 \cong \frac{4\pi}{\lambda}(\Delta h(n,m)\cos\theta + R_1) \quad (10)$$

where $\Delta h$ assumes negative values in the plotted direction, and $\theta$ is the angle from (n,m) to the z axis, which is relatively known. The measured $\psi(n,m)$ is now subject to $2\pi$ ambiguity. A slightly different wavelength or carrier frequency can be used, which according to the measured $\Delta\psi$ relating to $\Delta h$ in the following manner:

$$\Delta\psi(n,m) \approx \frac{-4\pi\Delta\lambda}{\lambda^2}(\Delta h(n,m)\cos\theta + R_1) \tag{11}$$

By measuring the $\psi(n,m)$ using the self-calibration described in this disclosure, it is possible to estimate the array structure deformation $\Delta h(n,m)$. Note that the lens-feed array enables this $\Delta h$ measurement because it uses free space as path to communicate between feeder and the array elements.

CLOSED-LOOP ARRAY ANTENNA CALIBRATION AND PHASING SYSTEM

A technical approach to the self-calibration and phasing of an array antenna has been described above. An examplary implementation of this new technique uses the central feed 10 as the focusing reference, the internal reflection of the array element through free space to measure the change in path length, and the synchronously varying phase shifters to provide distinguishable frequency modulation to identify the return of each array element.

Figure 5:
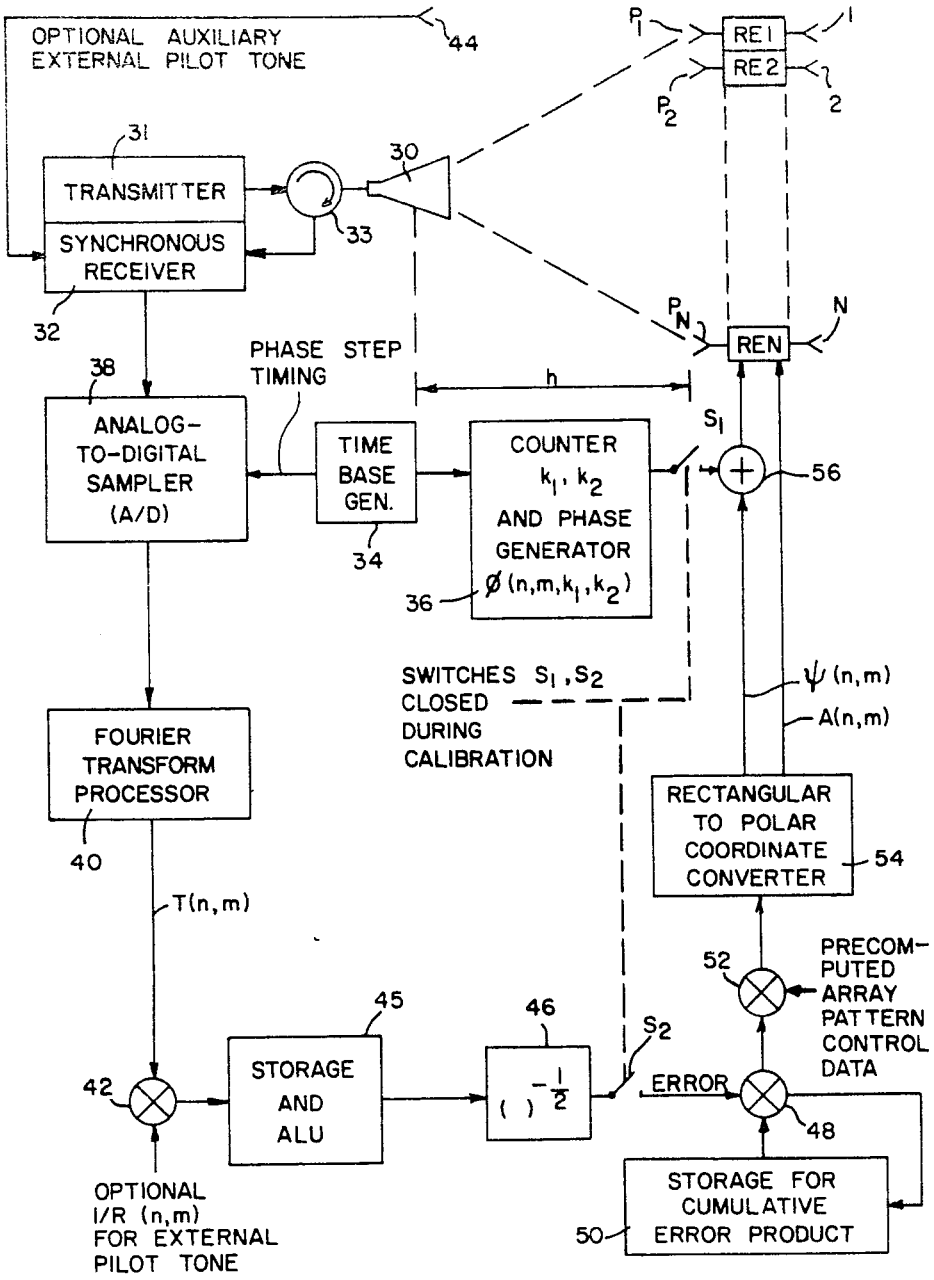
FIG. 5 illustrates an exemplary embodiment for the arrangement of the present invention illustrated in FIG. 1.

A functional block diagram of this new technique used for a closed-loop control of the antenna pattern is shown in FIG. 5. The upper part of the figure shows a lens-feed array antenna that is essentially the same as described with reference to FIGS. 1 and 2. It consists of a central transmitter 31 and synchronous receiver 32, coupled by a circulator 33, and an array of radiating and receiving elements 1, 2 . . . N. Note that a lens-feed array of radiator electronics RE1, RE2 . . . REN is essential in the design to obtain deformation measurement and corrections, which is one main objective of the design as opposed to a corporate feed (wire-linked) array antenna.

The self-calibration and phasing scheme consists of a time based generator 34 to synchronize a counter and phase generator 36, and to synchronize a data sampler 38. The phase generator 36 is used to generate the phase shift in step k according to Equation (2). An A/D sampler 38 provides sampled coherently demodulated output of the central receiver 32 to a Fourier transform processor 40 in digital form. The closed loop is completed by an optional multiplier 42 which is provided to compensate for the orientation effect of an external pilot-tone source received through an auxiliary antenna element 44. A storage and arithmetic logic unit (ALU) 45, a square-root reciprocal operator 46, a multiplier 48 and storage 50 for the cumulative product or estimate of the array compensation function, a multiplier 52 to incorporate precomputed array pattern control, and a rectangular to polar (x,y to $\psi$,A) of the form $A=(x^2+y^2)^{\frac{1}{2}}$, $\psi=\tan^{-1}(y/x)$ coordinate converter 54 to generate phase and amplitude control signals for the array element. Note that switches $S_1$ and $S_2$ must be closed during the calibration mode of operation. Switch $S_1$ allows modulation of the phase signal $\psi$ from the coordinate converter with the output of the phase generator 36, using an adder 56. This effectively modulates separately the signal received by the synchronous receiver from the individual ports $P_1$, $P_2$ . . . $P_N$. Switch $S_2$ allows an error signal to be accumulated in the storage 50.

The operation of the closed-loop calibrator will now be described. The central feed 30 continuously transmits a coherent wave to the array and receives echoes returned from the array. The phase shifters in the array elements are programmed according to Equation (2) as a function of element (n,m) and timing step ($k_1$, $k_2$). It is to be understood that the proper phase biases to achieve a desired lens function are preserved for the antenna elements during the calibration mode of operation in the reciprocal phase shifters.

The synchronously demodulated echo signal is sampled at the A/D sampler 38 with timing signals provided by the time base generator 34. A data storage buffer may be provided at the input of the Fourier transform processor 40 to temporarily store the sampled echo signal. The Fourier transform processor can be realized by a Fast Fourier transform (FFT) processor.

The Fourier transformed output may be multiplied by 1/R(n,m) of Equation (7) for one mode of calibration using an external pilot tone as described hereinbefore. The resultant data is stored in the storage portion of the unit 45 to perform vectorial averaging for improved signal-to-noise ratio (SNR) and to resolve the $2\pi$ phase ambiguity which requires the measurement of antenna transmittance over more than one wavelength.

The refined estimate on the offset in the two-way transmittance will go through a square root and reciprocal process in the operator 46. The output of this operator is the error signal in the one-way transmittance to be applied as the array control. This error signal is multiplied by the previous accumulated products of the error for an iterative closed-loop control system. Note that when perfect compensation is achieved, the error signal from square-root inverter is unity. The accumulated error product is multiplied by a precomputed array pattern. The product is then converted into separate phase ($\psi$) and amplitude (A) control signals to set the phase-shift angles and antenna array gains in the radiator electronics. Note that while phase-shift control signals $\psi_1$, $\psi_2$ . . . $N_3$ are applied to the respective phase shifters, as indicated in FIG. 2, the amplitude control signals are applied to the amplifiers (power and preamp) of the respective radiator electronics.

The following details of the calibration and phasing operation should be noted:

(1) The calibration can be done in an open-loop fashion before the square root and reciprocal operation for the three modes described by Equation (9). After separately determining $T_1(n,m)$, $T_2(n,m)$ and $T_3(n,m)$ by these three modes in open loop, they are in the manner described for T(n,m) in the closed loop mode to determine the phase shift and gain control signals to be applied to the radiator electronics. This procedure also enables separate control of the phase shifters and the transmit and receiving amplifiers of the array elements.

(2) Reflection from the stationary support structure of the array may be strong. This signal has a zero frequency modulation. For proper operation, separation of modulation frequencies for array elements away from zero is recommended.

(3) The accumulated error product is generated to correct the antenna pattern such that it will conform to the pattern specified by the precomputed array pattern control data, at which time the error signal will, of course, have been driven to unity. If the phase angles are predominantly affected by the array deformation, then the conjugations can be used to estimate the array deformation according to Equation (11).

(4) The precomputed array pattern control data can be in any form for a normal planar wave, a steered beam, a focused beam, etc. The computation is as usual for an ideal array as the offset will be compensated by the reciprocal of the measured transmittance. The pattern control can also be in the form of phase shift angles, e.g., Equation (1). In this case, the multiplier 52 will be replaced by an adder between the coordinate converter 54 and the adder 56 for adding the phase shift angles.

(5) According to Equations (2), (3) and (4), a j-bit phase shifter in an array element, which provides a $2^{-j}$ cycle phase resolution can provide the exact solution of T(n,m) if $2^{j-1}$ is an integer multiplier of both N and M.

(6) Noise reduction may also be done by increasing the time interval of step k, and to apply lowpass filtering or integration in the data sampler prior to the Fourier transform processing.

In summary, a central feed broadcasts a carrier wave to the array elements individually equipped with radiation electronics that includes a reciprocal phase shifter. A central synchronous phase detector realized by a Fourier transform processor provides the response T(n,m) of the array elements. By advancing the phase shift angles at different rates, each phase shifter introduces a distinct frequency modulation to the reflected carrier wave. The distinct modulation is resolved by the Fourier transform processor. The compensation required for each element in order for the array to conform to a precomputed array pattern is derived from the reciprocal square root of the response function.

The phase angles $\psi(n,m)$ should all be zero for an idealized perfect system, because the precomputed phase shift for the desired array pattern does compensate for the different broadcast path lengths of the antenna elements required to achieve the desired lens focusing effect. The residual phase error of an imperfect array element is indeed the compensation required for the desired antenna pattern.

Although particular embodiments of the invention have been described and illustrated herein, it is recognized that variations and equivalents may readily occur to those skilled in the art. For example, although one- and two-dimensional planar arrays have been used to illustrate the invention, the array may in sme installations not be planar, but the radiation electronics may nevertheless be controlled to produce a planar wave front. The organization and operation of the invention would remain the same. Also discrete functional units for the phase controller have been illustrated and referred to, whereas in practice they might well be implemented by a programmed digital computer or microprocessor. Consequently, it is intended that the claims be interpreted to cover such variations and equivalents.

What is claimed is:

1. In a phased array antenna incorporating a separate reciprocal phase shifter in the broadcast path from a central feed to each antenna element, each phase shifter being individually controllable, a method for self-calibration and phasing said array elements to compensate for any deviation from a precomputed pattern from an assumed array structure comprising the steps of broadcasting a continuous coherent reference wave from said feed to said elements, while stopping normal operation and with said phase shifters set to perform a lens operation for said precomputed pattern using said assumed array structure, and receiving at said feed electromagnetic wave energy returned from each phase shifter, advancing the phase angle of said phase shifters at different rates, thereby providing distinct frequency modulation of returned energy from said phase shifters, coherently demodulating the composite of return energy received by said feed, deriving a response function for each antenna element as the Fourier transform of the demodulated return energy, deriving an error signal for each antenna element as the reciprocal of the square root of its response function, and using said error signal for each antenna element for phase compensation of its phase shifter.

2. The method as defined in claim 1 wherein said phase shifter for each antenna element is part of radiator electronics which includes a short circuit switch selectively closed during calibration for reflection of said broadcast wave immediately after the reciprocal phase shifter, a power amplifier and receiver preamplifier coupled to said antenna element by a circulator and coupled to the phase shifter by a directional coupler, whereby return of broadcast wave energy to said central feed may occur by leakage through said radiator electronics, the steps of calibration with said switch closed to obtain a response $T_1$ for each antenna element phase shifter from the Fourier transform operation, calibration with said switch open to obtain a response $T_2$ for each antenna element from energy returned through leakage of the circulator, calibration with an external pilot tone received directly through a separate antenna element to measure just the antenna receiver response $T_3$, and obtaining the responses $T_{100}$ of the reciprocal phase shifter for each antenna element, the response $T_t$ of said radiation electronics for each antenna element, and the response $T_r$ of the antenna receiver alone by solving the following simultaneous equations $$T_{t100}(n,m)=T_1(n,m)$$

$$T_{b}(n,m)\times T_t(n,m)\times T_r(n,m)=T_2(n,m)$$

$$T_{t100}{}^{\frac{1}{2}}(n,m)\times T_r(n,m)=T_3(n,m)$$

where the array is already self-calibrated and phased for a predetermined antenna pattern such that all $T_1$, $T_2$ and $T_3$ are assumed to be properly compensated.

3. A method for on-board self-calibration and phasing of an array antenna having a plurality of antenna elements distributed in an array, each element being equipped with separate radiator electronics including a reciprocal phase shifter, and having a central feed for broadcasting a coherent wave to said array elements through their respective radiator electronics, the calibration steps carried out while normal operation is stopped, comprising broadcasting a continuous and coherent carrier wave from said feed to said array elements through their respective phase shifters set to perform a perfect lens operation for a precomputed array pattern which assumes a predetermined array structure, advancing the phase angles of said phase shifters at different rates relative to one another, thereby to effect a distinct frequency modulation of the reflected signal from each phase shifter, receiving through said feed returned electromagnetic wave energy from the phase shifters of said array elements, coherently demodulating the composite return signal received at said feed from said phase shifters, deriving the Fourier transform of the demodulated composite signal to determine the response for each element of the array antenna, deriving an error signal for each antenna element that is the reciprocal of the square root of said antenna response for each antenna element, and deriving from said error signal the phase compensation required to be combined with predetermined array pattern control to compensate for any deviation from said predetermined array structure, whereby the array antenna thus compensated will be correctly phased to achieve said precomputed array pattern during normal operation.

4. A method as defined in claim 3 wherein said array is a two-dimensional array with NxM elements located on a rectangular grid, each element being identified by its position (n,m) in the array, where the step of advancing the phase angles of said phase shifters at different rates relative to one another is comprised of advancing said phase shifters in discrete timing steps for each element.

5. A method as defined by claim 4 wherein discrete samples $Q(k_1, k_2)$ of the returned signal received from each element through said feed are taken to derive a response function T(n,m) from said Fourier transform which corresponds directly to the amplitude and phase response of each particular array element (n,m).

6. A method as defined in claim 3, 4 or 5 wherein all of the steps, except the last two are repeated several times at different carrier frequencies and the Fourier transforms are stored and vectorially averaged, thereby to improve the signal-to-noise ratio in the response function of each element, and to resolve any $2\pi$ phase ambiguity which requires measurements of the reflected signals over more than one wavelength.

7. A method as defined in claim 6 wherein the error signal of each element is multiplied by previous accumulated products of that error signal and stored for an iterative closed-loop control of calibration and phasing of said array antenna.

8. A method as defined by claim 7 wherein said radiator electronics includes amplifiers for gain control, and wherein the step of deriving the phase compensation required to be combined with predetermined pattern control for each element includes converting said accumulated product for each element from rectangular to polar coordinates $\psi(n,m)$ and A(n,m) where $\psi$ is phase angle and A is radiator electronics gain control.

9. Apparatus for on-board self-calibration and phasing of an array antenna having a plurality of antenna elements distributed in an array, each element being equipped with separate radiator electronics including a reciprocal phase shifter, and having a central feed for broadcasting a coherent wave to said array elements through their respective radiator electronics, comprising means for broadcasting a continuous and coherent carrier reference wave from said feed to said array elements through their respective phase shifters set to perform a perfect lens operation for a precomputed array pattern which assumes a predetermined array structure, means for advancing the phase angles of said phase shifters at different rates relative to one another, thereby to effect a distinct frequency modulation of the reflected signal from each phase shifter, means for receiving through said feed reflected electromagnetic wave energy from the phase shifters of said array elements, means for coherently demodulating the composite return signal received at said feed from said phase shifters, means for deriving the Fourier transform of the demodulated composite signal to determine the response for each element of the array antenna, means for deriving an error signal for each antenna element that is the reciprocal of the square root of said antenna response for each antenna element, and means for deriving from said error signal the phase compensation required to be combined with predetermined array pattern control to compensate for any deviation from said predetermined array structure, whereby the array antenna thus compensated will be correctly phased to achieve said precomputed array pattern during normal operation.

10. Apparatus as defined in claim 9 wherein said array is a two-dimensional array with NxM elements located on a rectangular grid, each element being identified by its position (n,m) in the array, where the means for advancing the phase angles of said phase shifters at different rates relative to one another is comprised of means for advancing said phase shifters in discrete timing steps for each element.

11. Apparatus as defined by claim 10 including means for taking discrete samples $Q(k_1, k_2)$ of the returned signal received from each element through said feed to derive a response function T(n,m) from said Fourier transform which corresponds directly to the amplitude and phase response of each particular array element (n,m).

12. Apparatus as defined by claim 9, 10 or 11 wherein all of said means, except the last two, are implemented to repeat their calibration functions several times at different carrier frequencies, and means for storing and vectorially averaging the Fourier transforms of each calibration, thereby to improve the signal-to-noise ratio in the response function of each element, and to resolve any $2\pi$ phase ambiguity which requires measurements of the reflected signals over more than one wavelength.

13. Apparatus as defined in claim 12 including means for multiplying the error signal of each element by previous accumulated products of that error signal and storing the products for an iterative closed loop control of calibration and phasing of said array antenna.

14. Apparatus as defined by claim 13 wherein said radiator electronics includes amplifiers for gain control, and wherein apparatus for deriving the phase compensation required to be combined with predetermined pattern control for each element includes means for converting said accumulated product for each element from rectangular to polar coordinates $\psi(n,m)$ and A(n,m), where $\psi$ is phase angle and A is radiator electronics gain.

* * * * *